United States Patent [19]

Corsette

[11] 4,345,383

[45] Aug. 24, 1982

[54] DESIGNER'S TRIANGLE

[76] Inventor: Douglas F. Corsette, 6559 Firebrand, Los Angeles, Calif. 90045

[21] Appl. No.: 153,858

[22] Filed: May 28, 1980

[51] Int. Cl.[3] ..... B43L 13/00

[52] U.S. Cl. ..... 33/474

[58] Field of Search ..... 33/494, 474, 476, 403, 33/429, 482

[56] References Cited

FOREIGN PATENT DOCUMENTS

| | | | |
|---|---|---|---|
| 127143 | 4/1948 | Australia | 33/474 |
| 585040 | 9/1933 | Fed. Rep. of Germany | 33/429 |
| 865714 | 2/1953 | Fed. Rep. of Germany | 33/429 |
| 908490 | 9/1945 | France | 33/489 |
| 1022765 | 12/1952 | France | 33/403 |
| 1086675 | 8/1954 | France | 33/476 |
| 301443 | 10/1932 | Italy | 33/494 |
| 154211 | 7/1932 | Switzerland | 33/474 |
| 276736 | 10/1951 | Switzerland | 33/476 |
| 667634 | 3/1952 | United Kingdom | 33/476 |

*Primary Examiner*—Harry N. Haroian

*Attorney, Agent, or Firm*—Henry M. Bissell

[57] ABSTRACT

A designer's triangle providing for the selection of angles from 15 to 90 degrees in a single implement, in increments of 15 degrees or less, and further including provisions for draft or taper angles to vary the aforesaid angles. Further embodiments include metric, fractional and tenth of inch embossed scales, protection against smudging, and marked or designated radii at a plurality of points on the triangle.

8 Claims, 7 Drawing Figures

DESIGNER'S TRIANGLE

BACKGROUND OF THE INVENTION

1. Field of the Invention

This invention relates principally to designer's triangles, and more particularly to triangles wherein a single implement has the capabilities of most of the known triangles, and thus eliminates the need for the use of at least two different triangles to perform designated tasks.

2. Description of the Prior Art

There are numerous triangles and protractors known in the art, and many are commercially available. One common form includes means for setting an adjustable angle which can be used to produce many different angles, as well as read angles off of drawings. Such equipment, however, is obviously subject to shifting and moving, if not exactly positioned or tightened, and thus requires a great deal of care in order to prevent errors in making drawings. In addition, in classroom drafting situations, protractors that have a plurality of holes, variable curvature arcs, a scale, and a few defined angles are well known. However, this type of unit does not provide for the production of numerous angles, and requires other equipment to produce drawings with angles other than the normal 30 and 45 degree angles provided on these units.

U.S. Pat. No. 2,080,620 discloses a drafting implement providing 15, 30, 45, 60, and 90 degree angles but, due to its four-sided "boomerang" shape, it only allows for a 15 degree angle from the horizontal. Additionally, due to its shape, a straight edge is not provided along two of the sides for use directly adjacent a tee square. Thus this instrument lacks the versatility of a triangular instrument, and other devices would be needed for efficient designing and drafting.

SUMMARY OF THE INVENTION

Arrangements in accordance with the present invention comprise a single designer's triangle having three external edges, with internal cutouts for both horizontal and vertical alignment of angles from 15 through 90 degrees in 15 degree increments. Thus use of this implement permits a designer to generate all of the usual right triangle angles formerly requiring use of two separate triangles (45—45 and 30–60 triangles, for example). The triangle is also usable as an instrument for straight edge measuring. The triangle has multiple scale divisions, and combines in a single unit all of the functions of a normal pair of triangles when used either individually, or in combination.

The three external edges of the triangle of the present invention, at their intersections, form or define angles of 75, 60 and 45 degrees. In addition, a portion of the planar sheet of material utilized to produce the triangle of the present invention is cutout in a triangular shape as well and defines a second internal triangle having 90, 75, and 15 degree angles. The hypotenuse of this internal triangle is perpendicular to one of the edges of the external triangle formed by the planar sheet, and the 15 degree angle of the internal triangle has a delineated arc at its apex.

In one preferred embodiment, scales are provided adjacent the external edges of the triangle for measurement, and these scales may be, for example, in millimeters, fractions of inches, and tenths of inches, respectively. In addition, the scales are embossed on the planar sheet surface of the triangle of the present invention, and serve to hold the triangle slightly away from the surface of the material being drawn on, thus minimizing smudging of graphite or other writing material during use.

The resulting pair of triangles allow a designer or draftsman to select a 15, 30, 45, 60, 75, or 90 degree angle, either horizontally or vertically from a previously selected line in a single instrument, and to complete his drawing of this angle without the use of a second triangle. The plural scales allow the designer/-draftsman to measure lengths, without resort to a further instrument, and the embossed surfaces allow the triangle of the present invention to be moved freely about the face of the drawing surface, without fear of smudging from contact with the large surface area of the triangle, as occurs in ordinary drawing situations.

In a further embodiment of the present invention, a plurality of further small angular cutouts are provided generally aligned along respective sides of the triangle. These angles, when provided in this embodiment, are preferably 2, 4 and 10 degrees, and are provided with bisector indications so that draft angles of plus or minus 1 and 2 degrees, respectively, commonly used in the tooling industry, are provided, and an angle of plus or minus 5 degrees, commonly used in foundries for castings and forgings, is also provided. Thus, the addition of these particular angular cutouts provides further utility to the single implement design of the present invention.

In yet another embodiment of the present invention, blend radii would be used on each of the external and internal angles provided in the triangle of the present invention. Each of these radii would be different, and the appropriate data including the radius, and the particular units of the radius would be embossed in the triangle. For example, conventional fillet radii, as used in drafting, could be provided at some angle vertices, fractional or decimal radii could be provided at other vertices, and metric radii could be provided at others.

BRIEF DESCRIPTION OF THE DRAWINGS

A better understanding of the present invention may be had from a consideration of the following detailed descriptions, taken in conjunction with the accompanying drawings in which.

BRIEF DESCRIPTION OF THE PREFERRED EMBODIMENTS

Figures 1, 2, 3:
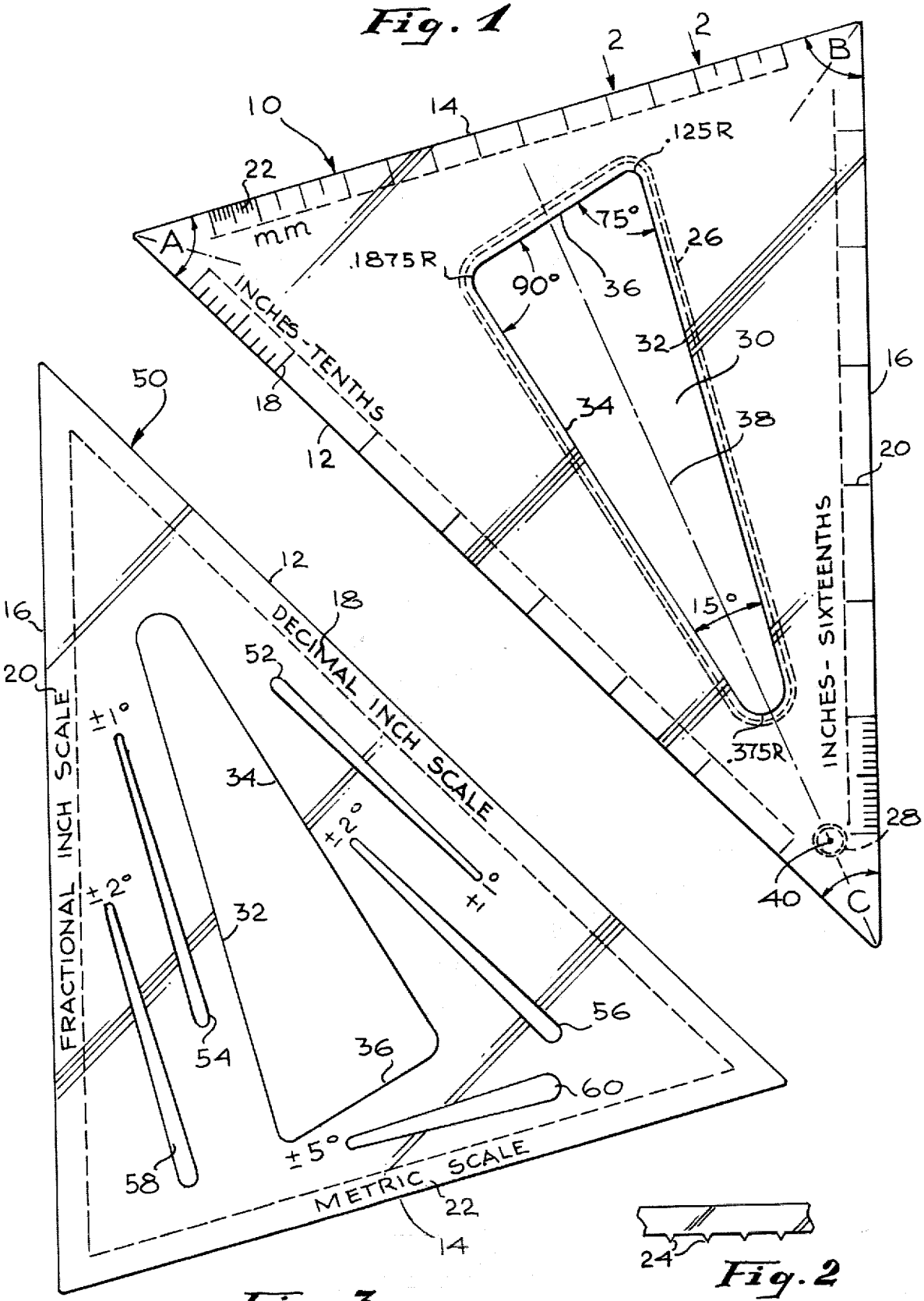
FIG. 1 is a plan view of an exemplary triangle comprising a preferred embodiment of the present invention.
FIG. 2 is an edge view of a portion of the triangle of FIG. 1, designated by the broken lines 2—2 and looking in the direction of the arrows.
FIG. 3 shows a variation of the device of FIG. 1 for particular use by tool and foundry designers.

In FIG. 1 a triangular implement 10 (herein referred to conventionally as a "triangle") is shown having external straight edges 12, 14 and 16. The edges 12 and 14 form an angle of intersection A equal to 60°; the edges 14 and 16 meet to form an intersection angle B equal to 75°; and the edges 12 and 16 meet to form an intersection angle C of 45°. The triangle 10 is preferably made of transparent plastic with different linear scales along the respective edges. For example, in one embodiment the scale 18 along the edge 12 provides measurements in tenths of an inch, whereas the scale 20 along the edge 16 is graduated in sixteenths of an inch and the scale 22 along the edge 14 is graduated in millimeters. Preferably the marks along the edges 12, 14 and 16 denoting the respective scale graduations are formed by raised marks embossed on the undersurface of the triangle 10, in the manner of the marks 24 shown in FIG. 2. These serve to raise the undersurface of the triangle 10 away from contact with the drawing paper on which the triangle is being used, thereby minimizing the smudging of the graphite from the drawing pencils. A similar embossed outline 26 is provided about the cutout in the center of the triangle and a similar circular support edge 28 is provided about a hole near the bottom of the triangle as shown in FIG. 1.

Within the external edges of the triangle 10 is a central cutout 30 having internal edges 32, 34 and 36. These edges intersect by respective pairs to form angles of 15°, 75° and 90°. The cutout 30 is placed so that the 15° angle straddles a bisector of the angle C; thus its own bisector line is coincident with the bisector line of the angle C, indicated by the broken line 38. The edge 32 is perpendicular to the external edge 14. A small hole 40 is located in the triangle 10 at the intersection of the extensions of the edges 32, 34, which hole lies on the bisector line 38. This hole may be used with a pin or pencil point to permit rotation of the triangle 10 for the convenience of the user in drawing lines at different respective angles, such as 15°, 30°, etc.

With the arrangement of the internal and external edges of the triangle 10, it will readily be seen that the user may draw straight lines at 15° and any selected multiple thereof. For example, lines drawn along the edges 16 and 32 or 12 and 34 converge at 15° angles. The edges 12 and 16 intersect at 45°. Lines drawn along the edges 16 and 34 or 12 and 32 converge at angles of 30°. Edges 16 and 14 intersect at 75°. Edges 32 (extended) and 14 intersect at 90°. The intersection of an extended line along edge 34 and the edge 14 form 105°, etc. In addition, the bisector line 38, portions of which are embossed on the triangle above and below the cutout 30, forms 22.5° angles with lines drawn along the edges 12 and 16 and 7.5° angles with lines along edges 32 and 34.

For further convenience of the user, different radii of curvature are provided in the corners of the cutout 30. Thus the radius at the 15° angle of the cutout 30 is 0.375 inch, that for the 75° angle of the cutout 30 is 0.175 inch and the radius for the 90° corner of the cutout 30 is 0.1875 inch. The radius of curvature for the exterior corners of the triangle 10 is typically 0.0625 inch, although other convenient radius dimensions or conventional sharp corners may be provided.

FIG. 3 shows a triangle 50 which is essentially like the triangle 10 of FIG. 1 insofar as the exterior edges 12, 14 and 16 and the interior edges 32, 34 and 36 are concerned. The respective scales 18, 20 and 22 are indicated to correspond to the scales in the triangle of FIG. 1. However, the triangle 50 of FIG. 3 is provided with a number of additional cutouts 52, 54, 56, 58, and 60. The cutouts 52 and 56 are aligned along the edge 12, while the cutouts 54, 58 are aligned along the edge 32, and the cutout 60 is aligned along the edge 14. The edges of the cutouts 52, 54 converge at an angle of 2° and the bisectors of their intersection angles are parallel with the edges 12 and 32, respectively. Thus the edges of the cutouts 52, 54 form angles of +/−1° with the edges 12, 32 with which they are respectively aligned. In similar fashion, the edges of the cutouts 56 and 58 converge at angles of 4°, meaning that these edges form angles of +/−2° with respect to the edges 12 and 32 with which these cutouts are respectively aligned. Finally, the cutout 60 provides edges converging at an angle of 10°, resulting in angles of +/−5° for these edges relative to the edge 14 with which the cutout 60 is aligned.

The triangle of FIG. 3 is particular useful for designers in specialized industries. For example, the +/−1° and the +/−2° vertical and horizontal draft angles are commonly used in the tooling industry. The +/−5° angles are used in foundries for castings and forgings (to permit removal of the casting from the mold, for example). While the cutouts have been described as being aligned with selected edges, it will be noted that these provide corresponding angles of deviation at 90° to other edges. For example, the cutout 60, while being aligned with the edge 14, is oriented orthogonally to the edge 32. Similar considerations apply to the other cutouts as well.

Figures 4, 5:
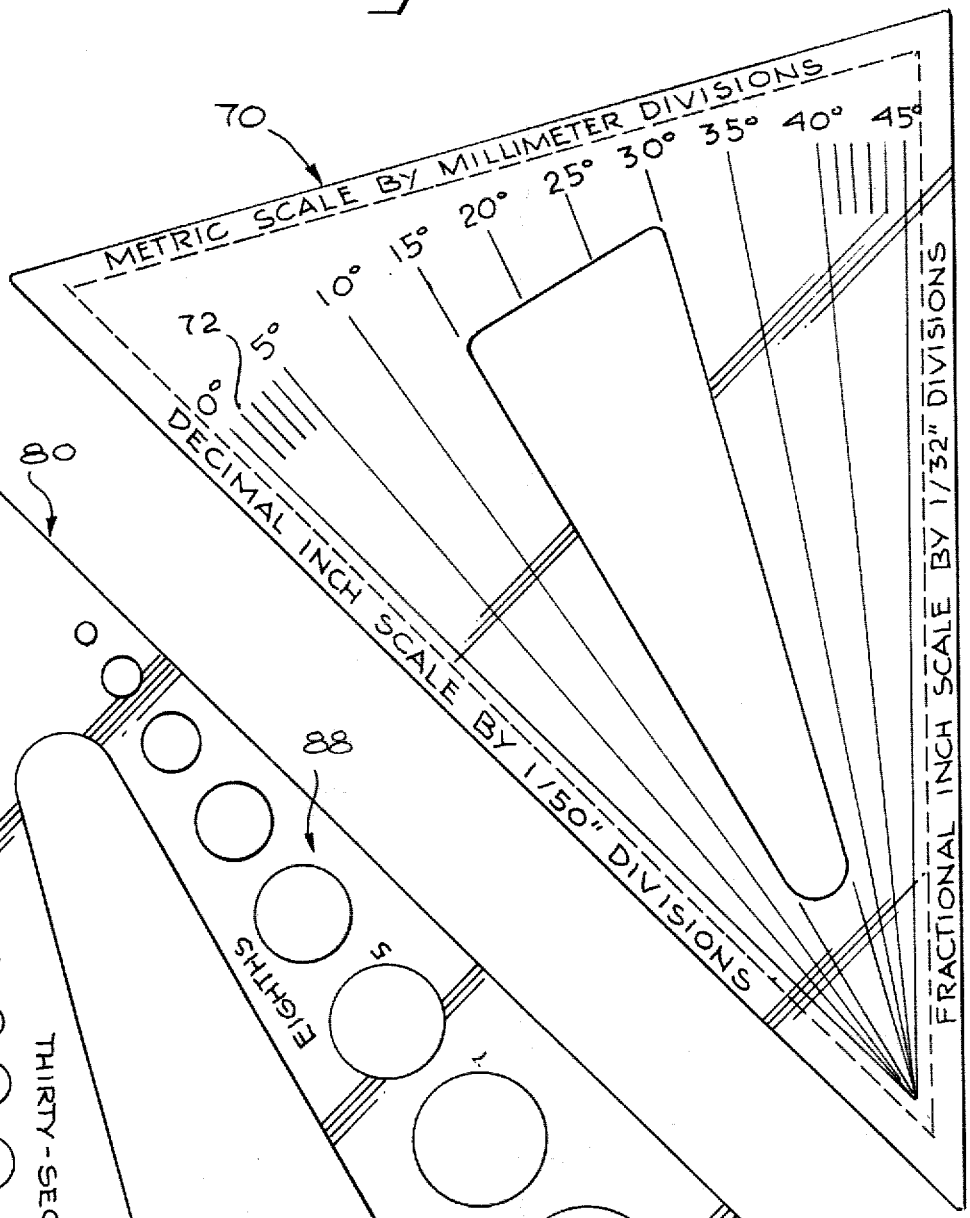
FIG. 4 shows another variation of the arrangement of FIG. 1 showing marks for a protractor inscribed on the device.
FIG. 5 shows another variant of the device of FIG. 1 in which a plurality of holes of different dimensions are provided for the convenience of the user.

FIG. 4 illustrates a triangle 70, generally of the configuration shown in FIG. 1, but with lines 72 representing the equivalent of a protractor embossed thereon. As shown in FIG. 4, these lines define 1° gradations from 0° to 45°. The protractor can as well provide similar gradations from 0° to 22.5° to either side of a bisector line such as the line 38 of FIG. 1.

FIG. 5 illustrates a triangle 80 much like the triangle 10 of FIG. 1, except that this triangle is provided with a plurality of circular cutouts arrayed in graduated sizes along the respective edges of the triangle. A first set 82 of such cutouts is graduated in sixty-fourths of an inch. A second set 84 is graduated in thirty-seconds of an inch, a third set 86 is graduated in sixteenths of an inch, and a fourth set 88 is graduated in eighths of an inch. A triangle such as 80 is particularly useful to designers of machinery, for example, where bolt holes, machine screws, and the like are commonly shown.

Figures 6, 7:
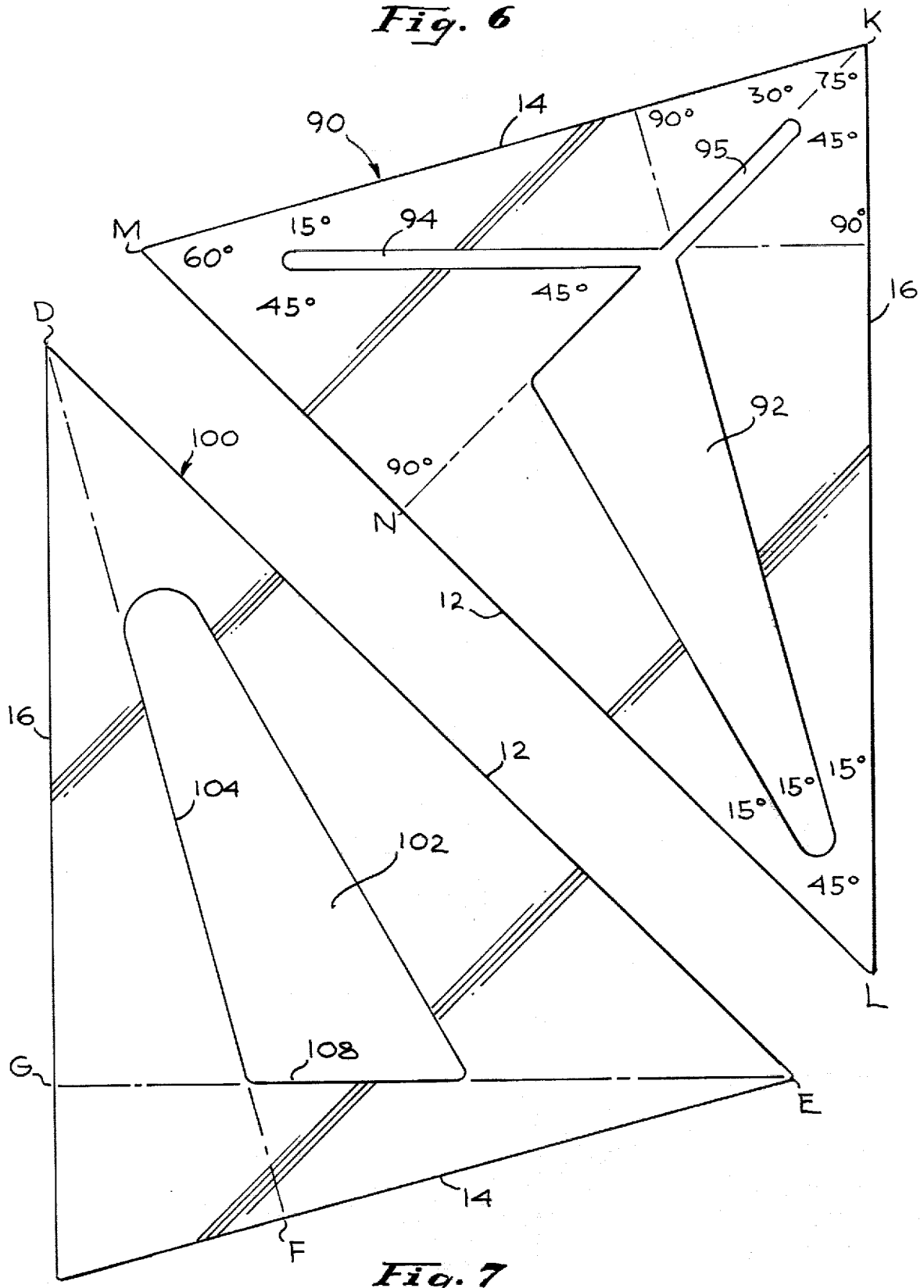
FIG. 6 shows still another variant of the arrangement of FIG. 1.
FIG. 7 shows another embodiment comprising internal and external triangles which constitute the combination of 30-60 and 45-45 degree right triangles.

FIG. 6 illustrates a triangle 90 having external edges arranged at angles corresponding to those shown in FIG. 1. A generally triangular cutout 92 is provided having internal edges oriented at 90° to the respective external edges. Two additional cutout portions are provided near the top of the triangle 90 along lines formed at 90° to the edges 12 and 16. These cutouts 94, 95 make it more convenient to draw a line at 90° to another line with which one of the edges 12 or 16 is aligned. Also, by virtue of the configuration of the various edges, a line drawn along the cutout 94 which is perpendicular to the edge 16 will form a 45° angle with a line along the edge 12, and will form an angle of 15° with a line along the edge 14. Similarly, a line along the cutout 95 which is perpendicular to the edge 12 will form a 30° angle with a line along the edge 14 and a 45° angle with a line along the edge 16. The triangle 90 may be considered to include the two standard designer's triangle—a 45°—45° triangle KLN and a 30°-60° triangle KMN—abutting along a common side KN.

FIG. 7 shows a triangle 100 much like the triangle of FIG. 1 except that the central cutout 102 is reversed in orientation, relative to the cutout 30 of FIG. 1. The edge 104 is still perpendicular to the edge 14, and is in line with the vertex D of the triangle 100. The edge 108 is perpendicular to the edge 16 and is in line with the vertex E. With the edges and embossed extension lines of the triangle 100 as shown in FIG. 7, the triangle can be considered as the combination of a 30°-60° right triangle with a 45°—45° right triangle. That is, triangle DEF represents a 30°-60° triangle, whereas the triangle DEG represents a 45°—45° triangle. Triangle 100 can be considered as the combination of these two triangles with their longest edges (hypotenuses) coincident. In use, the triangle 100 may readily be rotated about a selected one of its vertices to develop any one of the most commonly selected angles of 30°, 45°, 60° and 90° of the two basic drafting triangles, as well as the 15° angles to the vertical and horizontal which normally require both triangles.

Although there have been described above specific arrangements of a designer's triangle in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A designer's triangle comprising:

a planar sheet of clear plastic material having three external edges forming a triangle with angles of 45°, 60°, and 75°, respectively;

said planar sheet defining a triangular cutout opening with three internal edges forming a right triangle having angles of 15°, 75° and 90°, respectively;

each of said internal edges being offset by 15° from its corresponding adjacent external edge;

said triangular cutout opening being oriented relative to the external edges such that the hypotenuse of the right triangle is perpendicular to the external edge which is opposite the 45° angle and the bisector of the 15° angle of the interior triangle coincides with the bisector of the 45° angle, said plastic sheet also defining a referencing hole at the intersection of said common bisector and the extensions of the two interior edges defining the 15° angle of the internal triangle.

2. The triangle of claim 1 further including a plurality of support members protruding from one surface of said planar sheet for spacing the planar sheet from contact with a surface on which the triangle is to be used, at least some of said support members being arrayed along the three external edges of the sheet in the form of indicia visible from the opposite side of said sheet, said indicia being arrayed as gradations in three distinct scales, the first scale comprising a fractional inch scale, the second scale comprising a decimal inch scale and the third scale comprising a metric scale, whereby to provide for enhanced accuracy of extrapolation of linear measurement.

3. The triangle of claim 2 wherein another of said support members comprises a triangular shaped boss surrounding the cutout opening and spaced from but adjacent to the respective edges of said opening.

4. The triangle of claim 1 wherein each corner of the interior triangular cutout is curved according to a different radius of curvature, the radius at the 15° angle being 0.375 inch, the radius at the 75° angle being 0.175 inch, and the radius for the 90° angle being 0.1875 inch.

5. The triangle of claim 4 wherein each of the exterior triangle corners is curved to a radius of curvature of 0.0625 inch.

6. The triangle of claim 1 including a plurality of additional cutouts having edges defining angles of 2°, 4° and 10° respectively, the bisectors of which are aligned parallel with respective adjacent edges of the triangle.

7. The triangle of claim 6 wherein the additional cutouts provide angles of deviation of +/−1°, +/−2°, and +/−5° respectively, relative to said adjacent edges.

8. The triangle of claim 1 further including a plurality of indicia signifying a plurality of angles in the form of a protractor, said indicia constituting lines converging at said referencing hole.

* * * * *